United States Patent [19]

Leonard

[11] 4,134,671

[45] Jan. 16, 1979

[54] INTERSECTING OPTICAL AND COPY SHEET PATH METHOD AND APPARATUS

[75] Inventor: William H. Leonard, Rochester, N.Y.

[73] Assignee: Xerox Corporation, Stamford, Conn.

[21] Appl. No.: 781,080

[22] Filed: Mar. 25, 1977

[51] Int. Cl.[2] ..... G03G 15/28

[52] U.S. Cl. ..... 355/8; 355/11; 355/66

[58] Field of Search ..... 355/8, 11, 3 R, 3 TR, 355/49–51, 66

[56] References Cited

U.S. PATENT DOCUMENTS 3,784,189 1/1974 Thiel ..... 271/45

*Primary Examiner*—Richard L. Moses

[57] ABSTRACT

A xerographic copying machine is configured such that the copy sheet feed path intersects the optical path. The optical path extends between the document platen at the top of the machine down into the machine to an elevation below a photoreceptor drum and then back up to an exposure station adjacent the drum. The copy sheet path extends generally linearly across the machine along a target line to the top of the photoreceptor drum.

19 Claims, 4 Drawing Figures

INTERSECTING OPTICAL AND COPY SHEET PATH METHOD AND APPARATUS

BACKGROUND OF THE INVENTION

This invention relates generally to a copying machine and more specifically to copy sheet transport methods and apparatus employed in xerographic copy equipment.

Packaging of the elements making up present day copy equipment is significant to its success in the marketplace. Compactness has meaningful significance to certain users because of economy of space as well as esthetics and other human factor considerations. The simplicity of machine construction and arrangement of course bears significantly upon such factors as maintanence and reliability.

Both compactness and simplicity have been achieved in many present day commercial copiers. These desired features are attained by exerting design pressures on the layout of the optical path and the copy sheet transport mechanisms. Previously known machine configurations have adhered to a complete separation of the optical path (projecting light images from a document to a photoresponsive member) and the copy sheet path (starting at an input tray and proceeding to the photoresponsive member where it receives a visible or toned image and then on to an output location).

A major technology for copying is, of course, xerography and it is the transfer xerography portion of the technology as distinguished from the electrofax portion that is of interest here. Transfer xerography is so named because copies of a document are made on ordinary paper. A latent image of the document is first created on a photoreceptor by exposing it to a light image of the document via an appropriate optical path. This latent image is made visible by depositing microscopic marking or toner particles on the latent image. This toned image of toner is thereafter transferred to a plain piece of paper and permanently fixed to the paper, typically by heating the toner which includes a thermoplastic component. In contrast, electrofax machines employ a copy sheet that has a photoreceptor coating. The latent image is formed, toned and fused directly on the copy sheet. This generally explains the comparatively compact and simplistic construction of electrofax copiers relative to transfer xerographic machines.

It follows that an important object of the instant invention is the improvement of transfer copying methods and apparatus.

Also, an object of the invention is to enable a copy sheet to intersect the optical path of a copying machine without effectively hindering the copying operation of the machine.

Another object intended by this invention is the development of copy sheet transport methods and apparatus that permit the movement of the copy sheets through the optical path of various types of light image projection equipment.

Yet a further object is to control the instant in time that a copy sheet is permitted to move into the optical path of copying equipment so that a transferred toned image is substantially intact.

In a similar vein, it is an object of the invention to move the copy sheets in a copying machine in a manner that permits a rapid and non-interferring intersection of the machine's optical path.

Specifically, in a copying machine of the type wherein a linear image segment of a document is created by moving a scanning device relative to a stationary platen, it is an object to move a copy sheet through the optical path associated with the scanning device by allowing the copy sheet to move with the scanning device but at a position to not interfere with the formation of copies.

Also, in copying machines having flash illumination systems for creating light images for projection to a planer photoresponsive medium, it is an object to move a copy sheet through the optical path associated with the illumination system at times outside the flash intervals.

Yet a further object, in copying machines of the type wherein the platen or document moves relative to a stationary lens system, is to move a copy sheet through the effective optical path of the lens system without interferring with the creation of a copy.

Still a further object of the instant invention is the synchronization of copy sheet movement within a copying machine with the machine operations giving rise to the creation of a copy such that the copy sheet can intersect the optical path of the machine without impairing the resultant copy.

Clearly, a major object of the present inventive effort is to enhance the compactness of copying machines.

BRIEF DESCRIPTION OF THE INVENTION

The foregoing and other objects of the invention presented here are achieved in one exemplary embodiment employing a transfer xerographic copying machine having a stationary platen, slot scanning optics and a drum photoreceptor. The optical path of the machine is generally parallel to the vertical axis of the photoresponsive drum. The platen is located at the object plane of the lens system horizontally at the top of the copying machine. The lens elements, contained in a single mounting barrel, are positioned close to the drum with the optical axis generally vertical. The image plane of the lens system coincides with an exposure station at the bottom of the photoreceptor drum. A transfer station is located generally at the top of the drum on the opposite side from the exposure station. The copy sheet path extends generally along the plane tangent to the drum at the transfer station. At one end of the copy sheet path a stack of copy sheets rest in a supply tray while at the other end of the path, the processed copy sheets come to rest in a collection tray.

In the above embodiment, the copy sheet path and optical path are arranged roughly at 90 degrees. The photoreceptor drum is positioned close to the intersection of the two paths. Consequently, the elements of the machine are compactly packaged. In addition, the very accessible, short and straight copy sheet path yields sheet feed reliability and ease of maintanence. Control means are included that command the moment at which the copy sheet moves into and through the optical path so as not to hinder machine performance.

BRIEF DESCRIPTION OF THE DRAWINGS

The above objects and features of the invention will be understood from the foregoing and that which follows when taken alone and in conjunction with the drawings in which.

DESCRIPTION OF THE EMBODIMENTS

Figure 1:
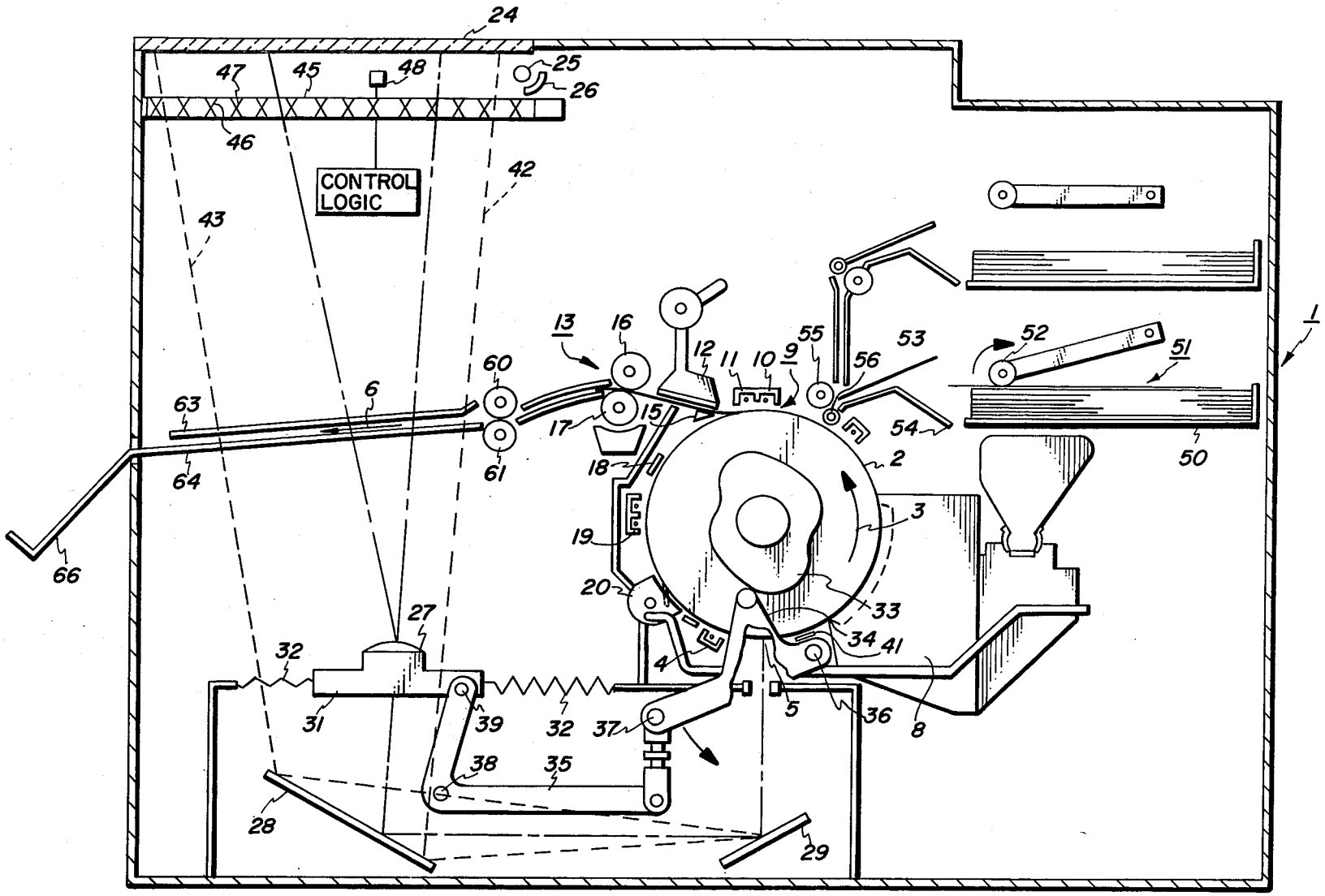
FIG. 1 is a, side elevation view of one embodiment of the instant invention.

As indicated in the brief description, an exemplary embodiment is disclosed in order to better define the invention. At the outset, is should be understood that the fundamental concept reported in this writing has application in other copying machine embodiments. This concept is the feeding of copy sheets through the optical path of the machine's lens system, during intervals between formation of latent images on the photoreceptor means or drum. Clearly, it is not obvious to feed the copy sheets through the optical path because the sheets would appear to interfere with the formation of the latent image. In addition, in xerographic systems, moving the copy sheets into the optical system exposes the lenses and mirrors to contamination by toner, dust, lint and other contaminants. (See U.S. Pat. No. 3,961,848 for a disclosure of the dirt problem. This patent is incorporated herein.)

The other embodiments to which the present invention are applicable include those copying machines employing photoreceptor means supported by belts rather than a cylindrical drum. Examples of such copying machines are the Xerox Corporation "9200" and the Eastman Kodak "Ektaprint 150". In each of these machines the lens systems are stationary and project full frame light images of a document on a flat, stationary platen to a flat or planer segment of a photoreceptor belt member journaled for rotation about support pulleys. (U.S. Pat. Nos. 3,796,486 and 3,876,106 and patents cited therein disclose belt type machines of this nature and are incorporated herein by reference.)

The flash illumination systems of these belt machines include lamps and reflectors mounted adjacent the platen to instantaneously flood or flash illuminate a document on the platen. The duration of the flash is chosen to be short compared to the velocity of the belt. Consequently, the movement of the belt during the flash has neglible impact on the quality of the latent electrostatic image formed on the xerographic photoreceptor belts.

Another embodiment to which the present invention has applicability is the curved stationary platen, oscillating scanning mirror, drum shaped photoreceptor copier depicted in U.S. Pat. No. 3,357,400. This type of configuration is commercially employed in Xerox "2400", "3600" and "7000" copying machines. The U.S. Pat. No. 3,357,400 patent is incorporated by reference into this application.

U.S. Pat. No. 3,963,345 discloses one machine having two separate optical paths. This patent is also incorporated by reference. The U.S. Pat. No. 3,963,345 patent has one image projection system wherein documents are transported past stationary optics. A lamp illuminates a linear segment of the document during its movement. The linear segment light image is projected to a first exposure station of a photoreceptor drum. The other image projection system involves scanning a document at rest on a planar platen. A lamp illuminates a linear segment of a document. This lamp and an associated mirror travel the length of the platen at a first velocity. The sequential linear light image segments are reflected to a second mirror that travels at substantially one half the value of the first velocity. This half-velocity mirror in turn directs the light images to a multiple element lens, another mirrior and ultimately to a second exposure station of the photoreceptor drum.

The configuration shown herein is based on that disclosed in U.S. Pat. No. 3,775,008 which is also incorporated into the present description. The embodiment is generally that of the copy machine marketed by the Xerox Corporation under the trademarks "Xerox" "4000".

THE EXEMPLARY EMBODIMENT

Referring to FIG. 1, copy machine 1 is a xerographic copying machine of the type described in the 3,775,008 patent. The copy sheet path of the machine described in the patent is modified according to the present invention by converting the generally U-shaped path to a generally linear path.

The copy machine includes a selenium photo-receptor 2 in a drum configuration. Drum 2 is journaled for rotation about its cylindrical axis in the direction of arrow 3. The selenium is deposited over a metal conductive core which is electrically grounded and provides the structural integrity for the drum. Charging corotron 4 deposits charged ions on the surface of the drum as it rotates. The charged selenium is subjected at exposure station 5 to an image pattern of electromagnetic radiation to which it is sensitive, generally referred to throughout as "light" and "light image(s)." The exposure of the charged drum creates a latent electrostatic image corresponding to the light image. This latent image is made visible by developer means 8. The developer is a well known magnetic brush development system which brings electrostatically charged, minute, toner particles adjacent the drum. The toner adheres to the drum in the regions corresponding to the latent electrostatic image.

The developed or "toned" images constructed of the toner particles moves with the drum toward the transfer station 9. This station includes the corotron 10 which deposits ions on the back side of a copy sheet fed to the drum in registration with the toned image. The copy sheet movements are discussed more fully later in this description. The charge associated with the ions on the back side of a copy sheet effect a transfer of the toned image from the surface of drum 2 to the copy sheet. Detack corotron 11 deposits charge on the backside of the copy sheet to assist in the separation of the sheet from the drum with stripper finger 15. The copy sheet stripped from drum 2 is directed and guided by means including vacuum manifold 12 into the bite or nip of the fuser mechanism 13.

The fuser 13 includes a heated roller 17 and back up roller 16. These rollers effect the transport of the sheet toward an exit from the machine 1 and in the process cause a permanent bonding of the toner particles comprising the toned image to the copy sheet. The further travel of the copy sheet is discussed later.

The surface of drum 2 which carried the toned image just transferred to a copy sheet now proceeds past a pre-clean illumination panel 18, a pre-clean corotron 19 and the blade cleaning means 20. The blade cleaner 20 wipes residual toner particles from the drum surface. Thereafter, the drum surface is exposed to a pre-charge illumination panel to level out the electrostatic charge on its surface before returning to to the charging corotron 4.

THE OPTICAL PATH

Machine 1 includes the document platen means 24. The platen 24 is a transparent, optically clear glass plate. It is a size to accomodate documents to be copied and is fixedly coupled to the frame of the machine 1. A lamp 25 and reflector are supported by suitable means to traverse the platen. The lamp and reflector are of a length to span the width of the platen. Together they cause light in a narrow linear segment to be projected to a document on the platen. Accordingly, as the lamp and reflector 25 and 26 traverse the platen 24, flowing light strip images of portions of a document on the platen are projected by the lens 27 and mirrors 28 and 29 to the exposure station 5. The platen 24 is at the object plane and the exposure station 5 at the image plane of the image projection system including the platen, the lamp, the lens and the mirrors.

The lens 27 includes multiple elements contained in a barrel which is supported by carriage 31, in a bellows 32. During rotation of drum 2, the carriage 31 moves synchronously on horizontal rails with the scanning lamp 25 and reflector 26 so that the segmented light images projected to the exposure station 5 are moving at the same velocity as a point on the surface of the drum located at the exposure station. If there is any significant difference in the scanning velocity of the lamp 25 and the drum surface, the latent image recorded by the drum 2 will be compressed or expanded depending upon the relative difference in velocities. In most copiers, the latent image is a one to one reproduction of the document (or nearly so, such as a 1.01 or 0.95 magnification.) In these situations the platen 24 and exposure station are located at generally two equal focal lengths from the lens 27. The velocity of the lens 27 for the 1:1 magnification is generally one half that of the scan lamp 24 since it travels generally one half the displacement in the same length of time, for scanning. The fly-back or return velocity in the opposite direction is much greater and need not be synchronized with the lamps return velocity.

The carriage and lens 27 are driven in a scan and fly-back reciprocating cycle by the drum mounted cam 33, cam follower 34 and lever 35. The cam 33 has a cam surface on which the follower 34 rides and is shaped to effect the desired motion of the lens 27 given above. The cam follower 34 is pivotally supported by pin 36 to the frame of machine 1. The pin 37 and appropriate adjustable linkage at the other end of follower 34 couples the follower to lever 35. Pin 38 pivotally couples the machine frame while pin 39 pivotally couples the lever to the carriage 31. The movement of the cam follower is thereby translated into reciprocating linear movement for the lens 27.

The boundaries of the optical path associated with the lens 27 include the platen 24 and exposure station 5 located respectively at the object and image planes. The extreme light rays 42 and 43 of light images projected from the platen to the exposure station define the extreme boundaries of the optical path in the plane of the drawing. The boundaries in the plane of the drawing are the ones of interest to illustrate the invention in the embodiment under discussion, since as will be discussed more fully later, the copy sheets pass through the optical path along a sheet path generally normal to rays 42 and 43.

Lights rays 42 and 43 are actually the extreme rays in a plane of light rays which extend in the direction into and out of the plane of the drawing. The plane of rays defined by the extremes 42 and 43 constitute the lead and trailing edges of the light image of a document projected across the breadth of drum 2 as the lamp 25 and lens 27 scan the platen 24 synchronously with the rotation of the drum.

The lens 27 moves in the same direction as the lamp 25. Since only a linear segment the width of drum 2 is projected, the copy sheet is able to pass through the optical path during the scan portion of the cyclic reciprocating motion of lamp and lens. The copy sheet must remain behind the lens an appropriate distance. During the fly-back portion of the scan cycle, the light image being projected may be interrupted by the copy sheet since imaging is not done during fly-back here. This fly-back speed of the lamp and lens is several times faster than the scanning speed. The resultant blurred image at the drum 2 is often relied upon as an interdocument erase lamp. Interdocument exposure erasure is accomplished in the present invention by the erase lamp 41. Lamp 41 uniformly erases the charges deposited by corotron 4 in those regions of the drum not bearing a latent image.

The traversing or scanning mechanism coupled to lamp 25 and reflector 26 includes the shaft 45. Shaft 45 is journaled for rotation and has oppositely cut helical grooves 46 and 47 on its surface. The shaft is rotated at a fixed angular velocity and the scan lamp and reflector are propelled at different speeds during a scan and fly-back motion due to the different pitch of grooves 46 and 47. The fly-back speed of the lamp and reflector is greater than their scanning speed. The motion of the copy sheet through the optical path is preferred to occur before the lamp and reflector start the fly-back position of their travel. The copy sheet is allowed to move with the lamp but at a distance behind the linear image. When the fly-back travel begins, the copy sheet is already advanced into the region of the optical path. Consequently, the effective throughput of the copy sheet across the optical path is improved.

Feeler switch 48 may be placed in the path of the carriage carrying the lamp and reflector at a location to trigger the feed of a copy sheet forward into the optical path. The switch location is empirically selected to match the process speeds in the machine. The requirement is to locate the feeder switch to detect that point in the scan travel of lamp 25 at which the copy sheet can be fed forward into the optical path without intersecting the linear image segments being projected to the drum 2. Switch 48 is coupled to appropriate circuits of conventional design and to the motor controls activating the feed rollers 60–61 that propel the copy sheet into the optical path. A copy sheet buckle or other detaining system may be positioned between the rollers 60–61 and the fuser 13. In other words, the control means for synchronizing the start of conveyence of a copy sheet through the optical path includes switch 48. However, with the appropriate choice of imaging and transfer stations and scanning drives, the copy sheet will leave the fuser at the proper time to begin traversing the optical cavity without requiring any delay.

THE COPY SHEET PATH

Copy sheets typically are $8\frac{1}{2} \times 11$ inch, twenty pound, bond paper. Various user requirements often require the copy sheet handling equipment to accept smaller and larger paper size formats and weights. Of significance, however, is the direction of feed of an individual sheet relative to its major and minor dimensions. In the case of the 8½ × 11 inch sheet, the 8½ inch side is the minor dimension and the 11 inch side is the major dimension. Several machine design considerations are effected by the selection of a copy sheet long edge or short edge feed orientation. For the present invention, it is preferred to feed the sheet such that its major or long edge is the lead edge of the sheet as it is conveyed through machine 1 so as to minimize the length of the sheet in the direction of movement through the optical path, and to also scan the document across its major or long edge to minimize the scanning distance. The machine herein, as mentioned earlier, is a variation of the Xerox 4000 copier machine which has its copy sheet feed path and scanning arranged in that manner.

Figure 2:
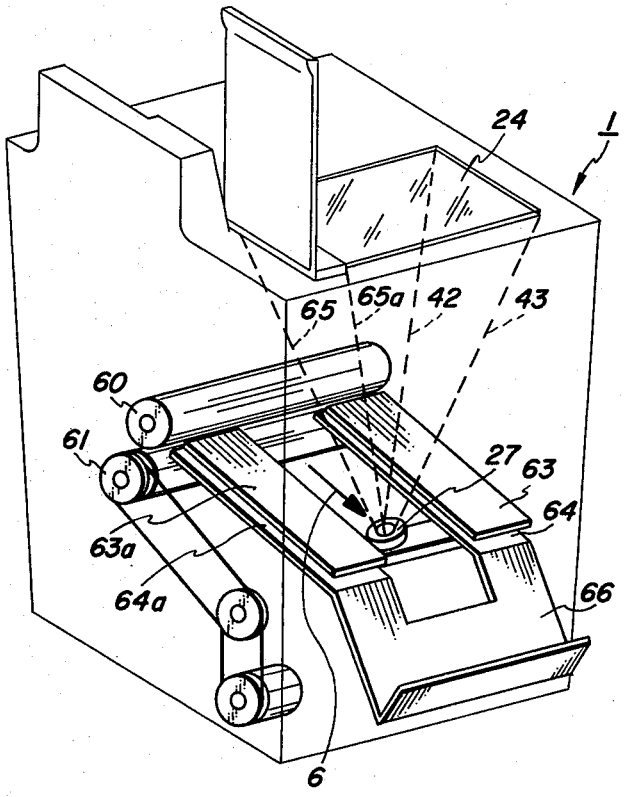
FIG. 2 is a partial, perspective view of the apparatus in FIG. 1 primarily intended to illustrate the copy sheet path as it intersects or passes through the optical path.

FIG. 2 illustrates most clearly the preferred location of copy sheet path 6 relative to the lens 27 and extreme rays 42 and 43. Path 6 intersects the optical path at angles about between 70° and 110°. In this particular lay-out of FIGS. 1 and 2, the intersection of copy sheet path 6 with the optical path is about mid-way between the platen 24 and lens 27. The extreme rays collected by lens 27 converge relative to one another as they approach the lens. At the point of intersection of the two paths, the width of the optical path is much less that it is near the platen. This means that the copy sheet has a much shorter distance to travel to get through the optical path compared to the distance near the platen. Also, only a portion of the copy sheet is in the optical path. The shortest intersection path for a copy sheet is at an intersection plane located immediately adjacent lens 27.

Tray 50 supports a stack of copy sheets 51. An appropriate sheet separation and forwarding device such as feed roller 52 engages the top sheet in the stack and forwards it toward the transfer station. The lead edge of a sheet is guided by plates 53 and 54 into the bite of registration and feed rollers 55 and 56. As is well known, the control means for a copying machine energizes feed roller 55 at the instant in time required to feed a sheet in its nip into registration with the lead edge of a toned image on drum 2.

The stripper means 15 separates the sheet from the drum and the sheet is directed by appropriate guide plates including vacuum manifold 12 to the bite of fuser rollers 16 and 17. The fuser rollers 16 and 17 permanently bond the toned image to the copy sheet and advance the sheet into the bite of the exit drive rollers 60 and 61. Roller 60 is a driven roller and roller 61 and idler roller. The two sets of parallel guide plates 63, 64 and **63*a*, 64*a*, provide a path for conveying the copy sheets through the optical path. Each set of guide plates is positioned outside the boundaries of the extreme rays of the optical path as illustrated in FIG. 2. The dashed lines 65 and 65*a* in FIG. 2 represent the two rear extreme rays in addition to the two front extreme rays 42 and 43 shown in FIG. 1**.

The major dimension across the optical path at the intersection point are, as explained earlier, less than the major dimension of the platen 24. At the intersection point illustrated by the present embodiment, the major dimension across the optical path is from 45 to 65 percent of that at the platen. Consequently, the full size copy sheet in a one to one copying operation can be guided by the plates 63 and 64 through the optical path without interferring with the projection of a light image to drum 2.

Alternately, the guide plates 63 and 64 are optically transparent glass plates that extend through the optical path. One glass plate is adequate when idler rollers or the like are used to keep the copy sheets against the plate glass. In addition, a pneumatic transport can be used to convey the copy sheets between two glass guide plates. A sheet transport of this type is disclosed in U.S. Pat. No. 3,984,098 and that disclosure is incorporated herein.

The sets of guide plates 63, 64 and **63*a*, 64*a*, grip the copy sheets on opposite edges. They terminate adjacent an output or exit location for machine 1 where the copy sheets come to rest in the collection tray 66. The exit feed rollers 60 and 61 impart sufficient energy to the copy sheets to move the sheets to the collection tray after the trailing edge of a sheet leaves the bite of the exit rollers. An endless elongated sheet drive belt or rollers could be used in place of guide plates 63 and 63*a*** or two rotating sets of belts in place of all of these guide plates.

In summary, the copy sheet paper path includes the path defined by the sheet motion of a sheet conveyed from input copy sheet tray 50 to the output collection tray 66. Further defining the path are: feeder 52; the guide plates 53 and 54; registration feed rollers 55 and 56; transfer station 9; stripper means 15; guide plate 12; fuser rollers 16 and 17; the exit feed rollers 60 and 61; and, the exit guide plates 63 and 64. In this embodiment, the copy sheets exit face down in collated order since they have not been turned over by the straight-out exit path from the bottom of sheet image transfer position provided here.

Figure 3:
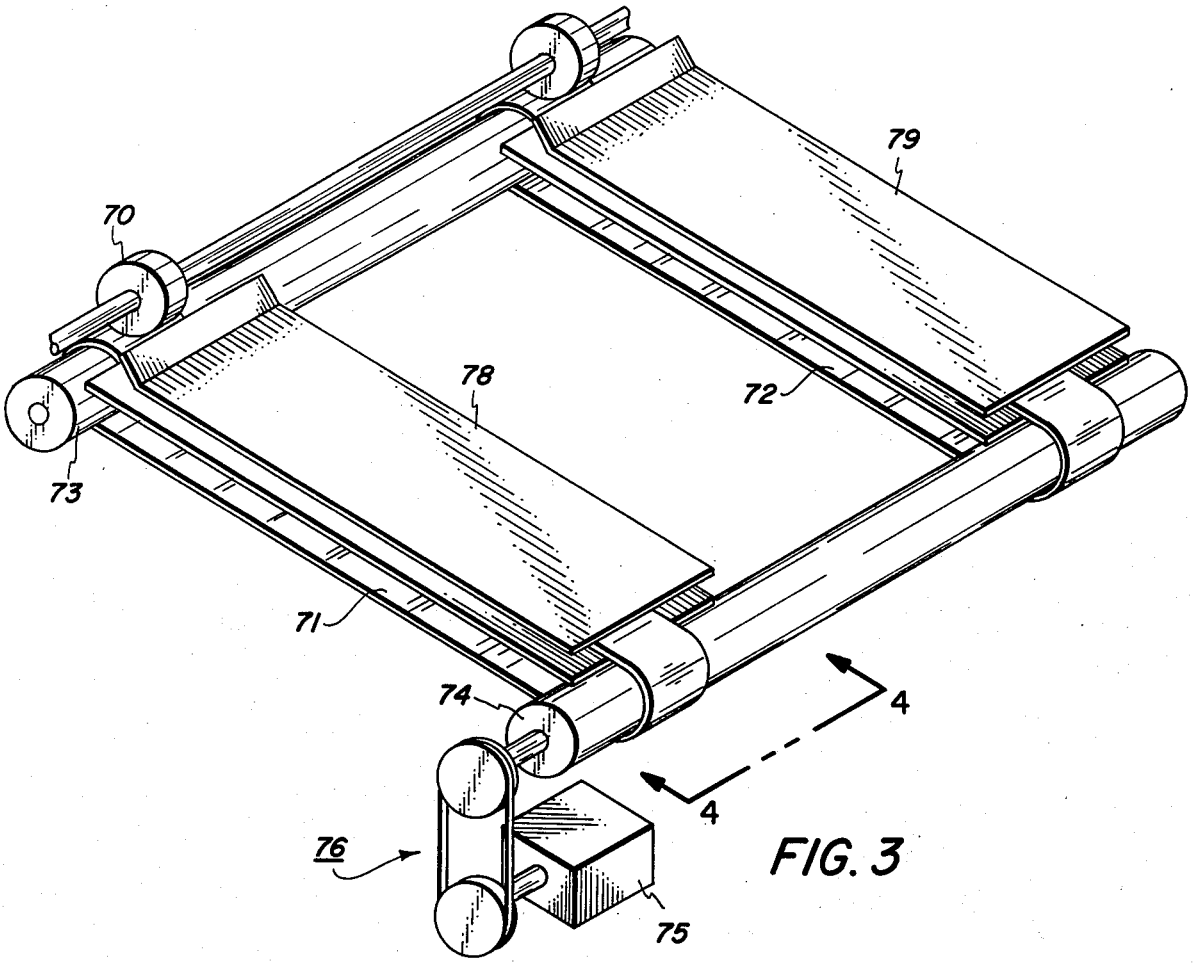
FIG. 3 is a partial perspective view of another embodiment of a transport for conveying copy sheets through a copy machine optical system.
Figure 4:
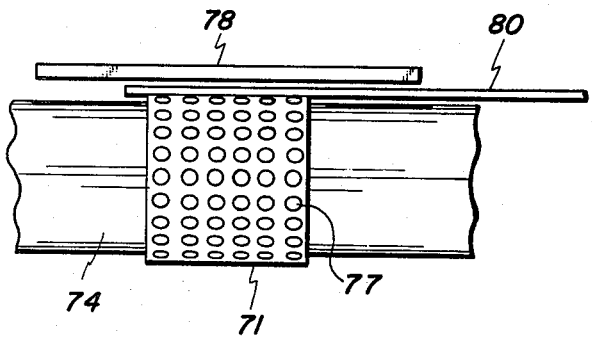
FIG. 4 is a partial end view of the transport means in FIG. 3 taken along the lines 4—4 of FIG. 3.

FIGS. 3 and 4 depict an alternate embodiment for transport means for conveying sheets through the optical path of the lens 27. The embodiment provides a drawing force for a copy sheet while the sheet is traversing the optical path.

The exit drive rollers 60 and 61 in FIGS. 1 and 2 are replaced by idler roller 70 and drive or transport belts 71 and 72 supported for travel about the pulleys or rollers 73 and 74. The rollers 70 and 73 are located substantially at the position of rollers 60 and 61 to drivingly engage copy sheets forwarded from the fuser 13.

Roller 74 is coupled to a drive motor 75 via appropriate drive linkage 76. The rotation of roller 74 circulates the transport belts 71 and 72 about rollers 73 and 74 in the direction to carry a copy sheet from rollers 70 and 73 to a collection tray such as tray 66 shown in FIG. 1. The belts 71 and 72 are made with fiber reinforced, elastomeric material. The holes or perforations 77 are added to reduce the mass of belt, improve its tracking about rollers 73 and 74 and enhance the driving engagement of the belts with a copy sheet.

Guides plate 78 and 79 are provided above belts 71 and 72 to ensure the conveyance through the optical path. The guide plates are made from aluminum sheets. As in the case of the embodiment in FIG. 1, these plates may be replaced with a single glass plate that is optically transparent and intersects the gap between rollers 71 and 72. The gap is such as to permit the extreme light rays (as shown in FIG. 2) to pass unobstructed.

FIG. 4 shows the relationship of the guide plates, rollers and a copy sheet 80. The copy sheet 80, is drivenly engaged by the rubber-like belt 71. Plate 78 is spaced slightly above the copy sheet a distance to accommodate the thickest copy sheet desired to be fed.

The foregoing embodiment is alterable in one significant manner to achieve the many benefits of the invention yet be fundamentally unique. That is, an arrangement wherein the copy sheet passes through the optical path during the travel of the copy sheet from the input copy sheet tray 50 to the transfer station 9 rather than during the sheet's travel from the transfer station to the collection tray 66. Specifically, the xerographic components shown in FIG. 1 could be relocated at substantially mirror image positions vis-a-vis the drum 2. Further, the lens 27 and associated equipment in the image projection means could be located on the opposite side of drum 2 while the copy path is altered appropriately to locate the guide plates 63, 64 and **63*a* and 64*a* on the supply tray 50** side of the drum.

Also, machine 1 is alterable by substitution of copy web for the cut sheet copy paper. Conventionally, a web of paper in roll form is supported at a position generally at supply tray 50. Means for severing the web are located between the web supply roll and a point corresponding to the exit feed rollers 60 and 61. In this embodiment, the web is severed before the paper enters the optical path.

A transparent plate, or spaced pairs of transparent plates, could be used as a copy sheet guide through the optics path in addition to or in lieu of the copy side (edge) guides 63–64 and **63*a*–64*a*. The copy sheets could be pneumatically ejected through such a spaced pair of horizontal plates into the output tray 66**.

A document engaging ramp or baffle may be provided centrally in the paper path at the copy exit area, to lift up the central, unsupported area of the sheet in case it has sagged down in its passage through the optics area.

Other modifications and variations are apparent from the drawings and a reading of the present description. These variations and modifications are intended to be embraced within the scope of the present invention.

What is claimed is:

1. Copying apparatus comprising:

photoresponsive means for recording latent images corresponding to light images, optics system means for intermittently projecting the light images along an optical path from an imaging station to the photoresponsive means for recording the latent images thereon, developer means for making toned images corresponding to the latent images recorded by the photoresponsive means, transfer means for transferring toned images developed on the photoresponsive means onto copy members, and transport means for intermittently conveying the copy members through the optical path of the optics system means only during time periods in which the copy members will not interfere with the projection of the light images along the optical path from the imaging station to the photoresponsive means.

2. The apparatus of claim 1 further including control means responsive to the generation of light images for controlling the conveyance of copy members through the optical path without interferring with the projection of light images to the photoresponsive means.

3. The apparatus of claim 1 wherein said transport means is positioned relative to the optical path and the photoresponsive means for conveying the copy members through the optical path after toned images are transferred to the copy members.

4. The apparatus of claim 1 wherein said transport means is positioned between a copy member input means and the photoresponsive means for conveying copy members through the optical path before toned images are transferred to the copy members.

5. The apparatus of claim 1 further including flash illumination means for illuminating documents to be copied at the imaging station during a flash interval within which neglibible copy sheet effective movement occurs for generating light images projected by the optics system means to the photoresponsive means.

6. The apparatus of claim 5 further including control means coupled to the flash illumination means for causing the transport means to convey copy members through the optical path at times excluding said flash interval.

7. The apparatus of claim 1 wherein said optics system includes scanning means adapted for movement relative to a document to be copied at the imaging station for generating partial image segments of documents sequentially which are projected by the optics system means to the photoresponsive means during a scan portion of the relative movement.

8. The apparatus of claim 7 further including control means coupled to the scanning means for causing the transport means to convey copy members through the optical path at times for maintaining copy sheets outside the partial image segments being projected to the photoresponsive means.

9. The apparatus of claim 7 further including a stationary platen means for supporting documents and wherein said scanning means moves relative to the platen means in a reciprocating cycle including said scan portion and a fly-back portion and wherein said transport means conveys copy sheets through the optical path during at least some fraction of both the scan portion and the fly-back portion of the cycle.

10. The apparatus of claim 7 further including means for moving documents past a stationary scanning means and wherein the transport means conveys copy members through the optical path during times that documents are not being moved past the scanning means.

11. A copier of the type having photoreceptor means for recording latent images corresponding to light images, lens systems means for projecting light images from an object plane to the photoreceptor means along an optical path, developer means for making toned images corresponding to the latent images recorded by the photoreceptor means and transfer means for transferring toned images from the photoreceptor means to copy sheets, the improvement being sheet transport apparatus comprising:

tray means for supporting a stack of copy sheets;

feeding means for separating the sheets and serially delivering them to a first transport means for conveying the sheets to the transfer means; and second transport means for conveying sheets from the transfer means through said optical path to an output location.

12. Copying apparatus comprising:

a photoresponsive drum for recording latent images corresponding to linear light images projected onto the drum during rotation of the drum;

developer means for making toned images corresponding to the latent images recorded by the photoreceptor drum;

transfer means adjacent the photoresponsive drum for transferring toned images from the drum to a copy sheet;

image projection means including platen means for supporting a document and lens means for projecting light images along an optical path from said platen means on one side of the drum to an exposure station on another side of the drum, and scanning means for sequentially generating partial light images of a document synchronously with the rotation of the drum and wherein a full latent image of the document is created upon the drum from the sequence of partial light images;

first copy sheet transport means for conveying copy sheets from a storage tray to said transfer means; and second copy sheet transport means for conveying the copy sheets along a sheet path from said transfer means through said optical path to an output location.

13. In a copying system with optics means wherein a document image is formed at a document imaging station and intermittently imaged onto an imaging surface, through an optics path extending through a lens spaced from said document imaging station, and wherein that image on said imaging surface is transferred to a copy member, and wherein said optics path converges from said document imaging station into said lens, the improvement comprising:

copy transport means for intermittently transporting a copy member from said imaging surface through said optics path in a copy path between said document imaging station and said lens, said copy path being substantially spaced from said document imaging station, said copy path being located at an area of said optics path where said optics path has converged to a substantially smaller area than the document image, and wherein said copy transport means and said optics means are coordinated to prevent said copy transport means or a copy member transported thereby from interfering with said imaging of said imaging surface from said document imaging station.

14. The copying system of claim 13, wherein said document imaging station comprises an intermittent flash illumination system for providing an intermittent flash exposure of documents, and wherein said copy transport means transports the copy member through said optics path only when said flash illumination system is not exposing documents.

15. The copying system of claim 13 wherein said copy transport means is outside of said optics path at all times and transports a copy member by engaging edges thereof extending outside of said optics path.

16. The copying system of claim 1, wherein said imaging surface is moving and said optics means includes optical scanning means for optically scanning in a scanning period, in coordination with said movement of said imaging surface, only a minor area of said document imaging station at any given moment of said scanning and utilizing only a minor area of said optics path at any given moment of said scanning; and wherein said copy transport means is adapted to move the copy members through said optics path in coordination with said optical scanning means to occupy only areas of the optics path not being utilized by said optical scanning means to image a document image on the imaging surface.

17. The copying system of claim 16, wherein said scanning means has a scanning period and a return-of-scan fly-back period, and said copy transport means moves the copy member through the optical path during said flyback period.

18. The copying system of claim 16, wherein said optical scanning means moves in a given direction in said scanning period and said copy transport means moves copy members in the same said given direction during said same scanning period, and wherein a copy member is transported through said optics path during said scanning period, outside of said minor area being scanned, in coordination with said scanning movement.

19. The copying system of claim 18, wherein said scanning means has a scanning period and a return-of-scan fly-back period, and said copy transport means also moves the copy member through the optical path during said fly-back period in which, said fly-back period being utilized by said copy transport means to complete the movement of the copy member through the optics path.

* * * * *